US011525191B2

(12) United States Patent
Kanemori et al.

(10) Patent No.: US 11,525,191 B2
(45) Date of Patent: Dec. 13, 2022

(54) PACK FOR SPINNING AND METHOD FOR PRODUCING FIBER

(71) Applicant: Toray Industries, Inc., Tokyo (JP)

(72) Inventors: Yasunori Kanemori, Otsu (JP); Joji Funakoshi, Otsu (JP); Atsuya Sakata, Nagoya (JP); Tomohiko Matsuura, Shizuoka (JP)

(73) Assignee: TORAY INDUSTRIES, INC., Tokyo (JP)

( * ) Notice: Subject to any disclaimer, the term of this patent is extended or adjusted under 35 U.S.C. 154(b) by 507 days.

(21) Appl. No.: 16/622,018

(22) PCT Filed: Jun. 13, 2018

(86) PCT No.: PCT/JP2018/022614
§ 371 (c)(1),
(2) Date: Dec. 12, 2019

(87) PCT Pub. No.: WO2019/003925
PCT Pub. Date: Jan. 3, 2019

(65) Prior Publication Data

US 2020/0208300 A1 Jul. 2, 2020

(30) Foreign Application Priority Data

Jun. 28, 2017 (JP) ..... JP2017-125813

(51) Int. Cl.
*D01D 4/02* (2006.01)
*D01D 4/06* (2006.01)
(Continued)

(52) U.S. Cl.
CPC ..... *D01D 4/025* (2013.01); *D01D 4/02* (2013.01); *D01D 4/06* (2013.01); *D01D 1/065* (2013.01);
(Continued)

(58) Field of Classification Search
CPC ..... D01D 1/065; D01D 4/02; D01D 4/025; D01D 4/06; D01D 5/088; D01D 5/0985; D01D 5/30
See application file for complete search history.

(56) References Cited

U.S. PATENT DOCUMENTS 3,608,148 A * 9/1971 Sluijters ..... B01F 25/422 425/464
3,761,559 A 9/1973 Heckrotte et al.
(Continued)

FOREIGN PATENT DOCUMENTS

CN 1272893 A 11/2000
CN 1375580 A 10/2002
(Continued)

OTHER PUBLICATIONS

Chinese Notice of Allowance for Chinese Application No. 201880031725.3, dated Oct. 28, 2021, with translation, 9 pages.
(Continued)

*Primary Examiner* — Xiao S Zhao
*Assistant Examiner* — Joseph S Leyson
(74) *Attorney, Agent, or Firm* — RatnerPrestia

(57) ABSTRACT

A pack for spinning is provided with a kneading part disposed on a spinneret. The kneading part includes: an introduction plate including a plurality of first introduction holes for introducing a melted polymer; and a plurality of kneading units including a supply plate including a plurality of independent supply grooves into which the polymer introduced from the introduction holes flows and one or more supply holes disposed in each of the supply grooves, and a converging plate including a plurality of converging grooves in which a plurality of grooves into which the
(Continued)

polymer supplied from the supply holes flows are intersected and a plurality of second introduction holes disposed in each of the converging grooves.

4 Claims, 7 Drawing Sheets

(51) Int. Cl.

| | |
|---|---|
| *D01D 1/06* | (2006.01) |
| *D01D 5/088* | (2006.01) |
| *D01D 5/098* | (2006.01) |
| *D01D 5/30* | (2006.01) |

(52) U.S. Cl.
CPC ..... *D01D 5/088* (2013.01); *D01D 5/0985* (2013.01); *D01D 5/30* (2013.01)

(56) References Cited

U.S. PATENT DOCUMENTS

| | | | | |
|---|---|---|---|---|
| 4,197,020 | A | 4/1980 | Doherty, III | |
| 5,137,369 | A | 8/1992 | Hodan | |
| 5,366,804 | A | 11/1994 | Dugan | |
| 5,525,282 | A | 6/1996 | Dugan | |
| 5,533,883 | A * | 7/1996 | Hodan | D01D 5/30 425/DIG. 217 |
| 5,551,588 | A | 9/1996 | Hills | |
| 6,361,736 | B1 * | 3/2002 | Dugan | D01D 4/06 425/464 |
| 6,565,344 | B2 | 5/2003 | Bentley et al. | |
| 7,887,728 | B2 | 2/2011 | Takatani et al. | |
| 2009/0295028 | A1 | 12/2009 | Rudisill et al. | |

FOREIGN PATENT DOCUMENTS

| | | | |
|---|---|---|---|
| CN | 1973065 | A | 5/2007 |
| CN | 201268732 | Y | 7/2009 |
| CN | 103261494 | A | 8/2013 |
| CN | 203360641 | U | 12/2013 |
| CN | 204224753 | U | 3/2015 |
| CN | 204401152 | U | 6/2015 |
| EP | 2660369 | A1 | 11/2013 |
| JP | 5024379 | B1 | 8/1975 |
| JP | 5024379 | B2 | 8/1975 |
| JP | 521123 | A | 1/1977 |
| JP | 57125776 | U | 8/1982 |
| JP | 04158003 | A | 6/1992 |
| JP | 04272210 | A | 9/1992 |
| JP | 0726420 | A | 1/1995 |
| JP | 09268418 | A | 10/1997 |
| JP | 2000265329 | A | 9/2000 |
| JP | 2006132057 | A | 5/2006 |
| JP | 2008038278 | A | 2/2008 |
| JP | 2010111977 | A | 5/2010 |
| JP | 2016188454 | A | 11/2016 |
| JP | 2017066560 | A | 4/2017 |
| WO | 2005010246 | A1 | 2/2005 |
| WO | 2012090538 | A1 | 7/2012 |

OTHER PUBLICATIONS

Chinese Office Action for Application No. 201880031725.3, dated Jun. 28, 2021 with translation, 13 pages.
Indian Examination Report for Indian Application No. 201947053074, dated Feb. 3, 2022, with translation, 6 pages.
International Search Report and Written Opinion for International Application No. PCT/JP2018/022614, dated Aug. 7, 2018, 6 pages.
Korean Notice of Submission of Opinion for Korean Application No. 10-2019-7035213, dated May 30, 2022, with translation, 11 pages.

* cited by examiner

PACK FOR SPINNING AND METHOD FOR PRODUCING FIBER

CROSS REFERENCE TO RELATED APPLICATIONS

This is the U.S. National Phase application of PCT/JP2018/022614, filed Jun. 13, 2018, which claims priority to Japanese Patent Application No. 2017-125813, filed Jun. 28, 2017, the disclosures of each of these applications being incorporated herein by reference in their entireties for all purposes.

FIELD OF THE INVENTION

The present invention relates to a pack for spinning and a method for producing a fiber using the pack for spinning.

BACKGROUND OF THE INVENTION

Generally, with regard to the production of a fiber in which a thermoplastic polymer is melt spun, chips serving as a raw material are melted and extruded with an extruder, and thereafter the polymer is introduced into a pack for spinning through piping for the polymer placed in a heating box. Thereafter, the introduced polymer is passed through a filter medium and filter disposed in the pack for spinning to remove foreign matters existing in the polymer and distributed by a porous plate. The distributed polymer is spun from the discharge holes of a spinneret and wound as filaments.

The pack for spinning is usually placed in a heating box in order to maintain the melted state of the polymer and heated at high temperature. In the heating in the heating box, the temperature of the inner layer part is lower than that of the outer layer part, which is in contact with the heating box, of the pack for spinning and temperature difference occurs in the inner and outer layers inside the pack for spinning. As a result, viscosity unevenness caused by thermal history difference between polymers passing through the inner layer and outer layer of the pack for spinning occurs to be a nonuniform polymer. This causes physical property difference among single yarns spun from each spinneret hole.

Therefore, in order to uniform the viscosity unevenness caused by the thermal history difference between the polymers passing through the inner layer and the outer layer of the pack for spinning and to reduce the quality difference, various studies have been conventionally made on the pack for spinning.

For example, Patent Literature 1 has disclosed a technique for uniforming a polymer by converging the polymer at the center part of the pack for spinning to reduce unevenness of quality such as shape and physical properties among single yarns by configuring a converging flow path in which the polymer is converged at one position while contracting the polymer flow at the center part of the pack for spinning, a plurality of circular tube flow paths circumferentially arranged at an equal interval extending from an outlet part at the end of the converging part in the downstream direction, and a circular flow path formed for circularly linking the start edge opening part of a discharge hole group drilled at an equal interval on the circumference into which the polymer flows and the end opening part of the circular tube flow paths.

Patent Literature 2 has disclosed a technique for uniforming flow of the polymer by repeating converging and distribution of the polymer by stacking mixing plates including a channel that changes a flow direction of the polymer and an outlet hole for flowing the polymer to the next plate, intersecting the channels so that the channels divide flow of the polymer to separate into two or more directions substantially perpendicular to a main direction, and configuring flow paths so that the each of the positions of the outlet holes of the adjacent plates are staggered.

PATENT LITERATURE

Patent Literature 1: Japanese Patent Application Laid-open No. 2010-111977

Patent Literature 2: Japanese Patent Application Laid-open No. H4-272210

Non Patent Literature

SUMMARY OF THE INVENTION

However, the pack for spinning described in Patent Literature 1 only converges the polymer at one position and distributes the polymer and the number of times of kneading the polymer is small. Consequently, a sufficient polymer kneading effect cannot be obtained. In particular, a polymer having high viscosity is in a laminar flow state and thus the kneading effect of the polymer is further reduced. Therefore, uniforming the viscosity unevenness among the polymers caused by the thermal history difference between the inner and outer layers may be insufficient and thus the quality difference among single yarns may fail to be eliminated.

The pack for spinning described in Patent Literature 2 repeats polymer converging and distribution. However, Patent Literature 2 has only described that the flow path divides the flow of the polymer to separate into two or more directions almost perpendicular to the main direction. On the other hand, in the case where attention is paid on the flow path holes, the positions of flow path holes of the adjacent mixing plates are required to be staggered. However, the positions of the flow path holes of the non-adjacent mixing plates are not required to be staggered. In fact, in a static mixing device in FIG. 1, the flow path holes of the mixing plate on the upstream side and the flow path holes of the mixing plate on the downstream side of one mixing plate are at the same positions. However, according to the findings of the inventors of the present invention, the mixing effect is low only by converging and distributing the polymer. Therefore, if the positions of the flow path holes at the upstream side and the downstream side are the same as described above, the polymer having a low degree of kneading returns to the same position and thus the sufficient polymer kneading effect may fail to be obtained even by repeating this operation. In particular, a polymer having high viscosity is in a laminar flow state and thus the kneading effect of the polymer is further reduced.

The present invention has been made in view of the above problems and an object of the present invention is to provide a pack for spinning capable of obtaining filaments having uniform quality without physical property difference and a method of producing a fiber.

A pack for spinning according to embodiments of the present invention to solve the problem is a pack that is used for a production process of a fiber and that is provided with a kneading part disposed on a spinneret. The kneading part includes: an introduction plate including a plurality of first introduction holes for introducing a melted polymer; and a plurality of kneading units including a supply plate including a plurality of independent supply grooves into which the polymer introduced from the introduction holes flows and one or more supply holes disposed in each of the supply grooves, and a converging plate including a plurality of converging grooves in which a plurality of grooves into which the polymer supplied from the supply holes flows are intersected and a plurality of second introduction holes disposed in each of the converging grooves. When the kneading part is divided into virtual regions including an equal area on a face perpendicular to a polymer spinning path direction and separated in parallel with the polymer spinning path direction from an upstream side end to a downstream side end, the first introduction holes penetrating the introduction plate are formed in each of the divided virtual regions; each first end of the supply grooves is disposed just below the corresponding first introduction hole or the corresponding second introduction hole, each second end of the supply grooves is disposed in a virtual region different from a virtual region where the first end is disposed, and each of the supply holes is formed in each second end of the supply grooves; the converging grooves are disposed in the respective divided virtual regions, each first end of the grooves configuring the converging grooves is disposed just below the corresponding supply hole, and each of the second introduction holes is formed in each second end of the grooves; and when attention is paid on the supply grooves on an upstream side and the supply grooves on a downstream side communicating with each other through the converging grooves, a second end of at least one supply groove on the downstream side is disposed in a virtual region different from any virtual regions where the first ends of the supply grooves on the upstream side are disposed.

In the pack for spinning according to a preferable embodiment of the present invention, the virtual regions where the first ends of the supply grooves are disposed are adjacent to the virtual region where the second end is disposed.

In the pack for spinning according to a preferable embodiment of the present invention, a degree of kneading M defined by the following formula:

$$M=(1-1/D^n)\times(1-1/R)$$

is 0.6 or higher where number of division of the virtual regions is R, number of the first introduction holes and the second introduction holes formed in one of the virtual regions is D, and number of components of the kneading unit is n.

A method for producing a fiber according to embodiments of the present invention includes producing a fiber using any one of the above-described pack for spinning.

The meaning of each term in the present invention will be listed below.

The term "polymer spinning path direction" refers to a main direction in which the polymer flows from a kneading part to the discharge holes of a spinneret.

The term "up" refers to a direction toward the upstream side of the polymer spinning path direction and "down" refers to direction toward the downstream side of the polymer spinning path direction.

The term "virtual region" refers to a region involving a plurality of first introduction holes, supply holes, and second introduction holes on faces perpendicular to the spinning path direction of the polymer, and separated in parallel with the spinning path direction of the polymer so that each area of the faces is equal.

The term "supply groove" refers to a groove acting as distributing the polymer in a direction perpendicular to the spinning path direction of the polymer.

The term "converging groove" refers to a groove acting as communicating the supply holes arranged on the upstream side of a converging plate and the supply holes arranged on the downstream side of the converging plate, converging the polymer supplied from the different supply holes in a direction perpendicular to the spinning path direction of the polymer, and thereafter distributing the polymer.

According to embodiments of the present invention, when a polymer flows in the pack for spinning in spinning of the thermoplastic polymer, the viscosity unevenness of the polymer caused by the thermal history difference of the inner and outer layers in the pack for spinning is uniformed and thus filaments having uniform quality without physical property difference can be obtained. A thermal effect receiving after kneading until discharge from the spinneret can be minimized by disposing the pack for spinning just above the spinneret.

DETAILED DESCRIPTION OF EMBODIMENTS OF THE INVENTION

Figure 1:
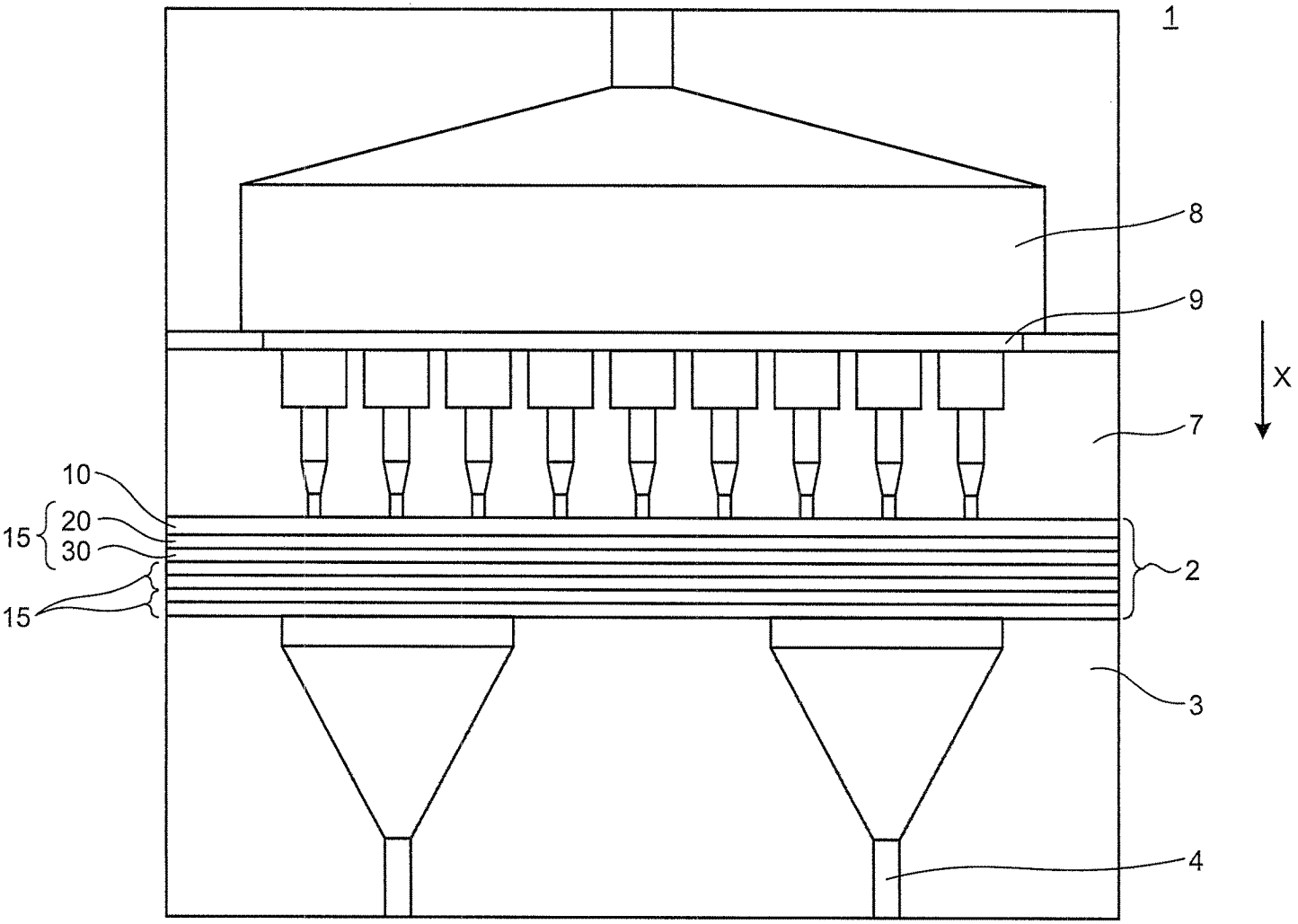
FIG. 1 is a schematic front sectional view schematically illustrating the pack for spinning according to an embodiment of the present invention.
Figure 2:
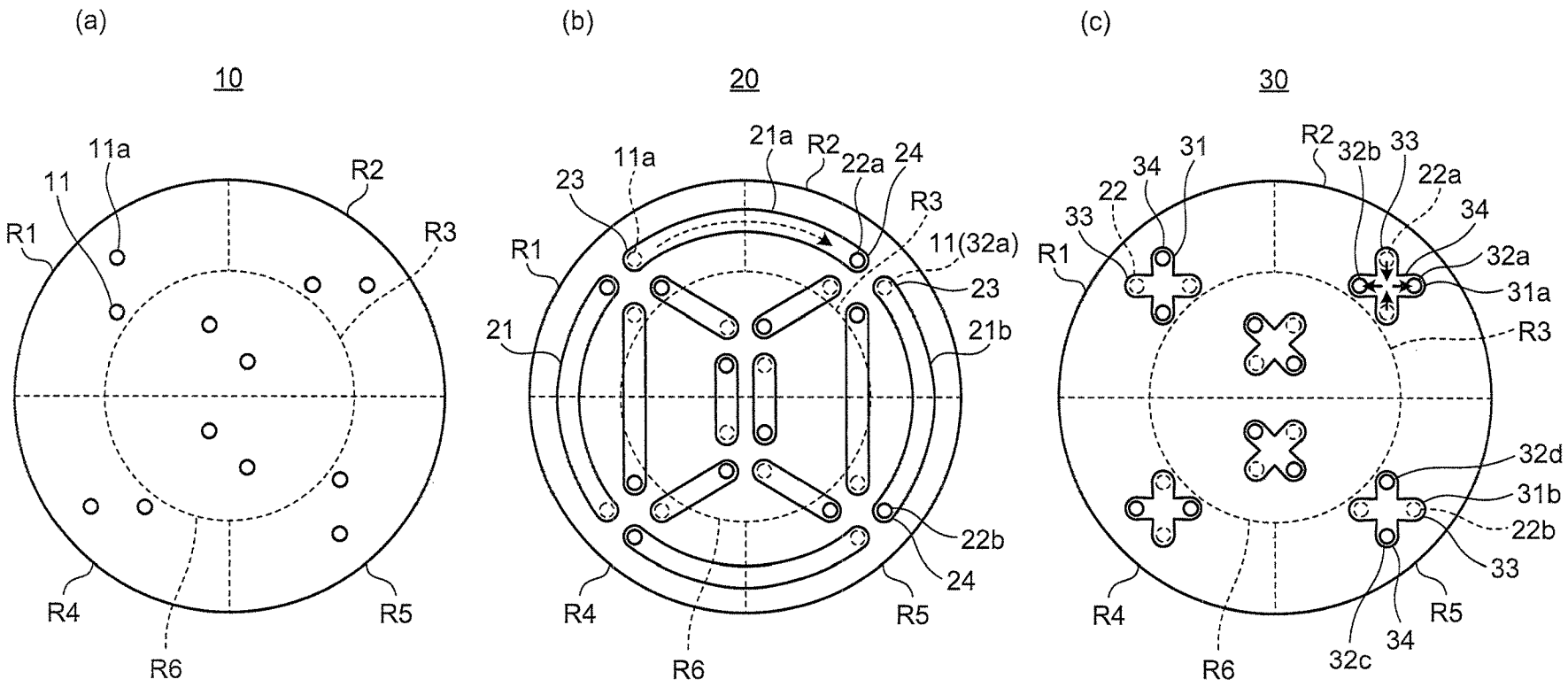
FIG. 2 is a schematic plan view of each of (a) an introduction plate, (b) a supply plate, and (c) a converging plate in the circular pack for spinning according to an embodiment of the present invention.
Figure 3:
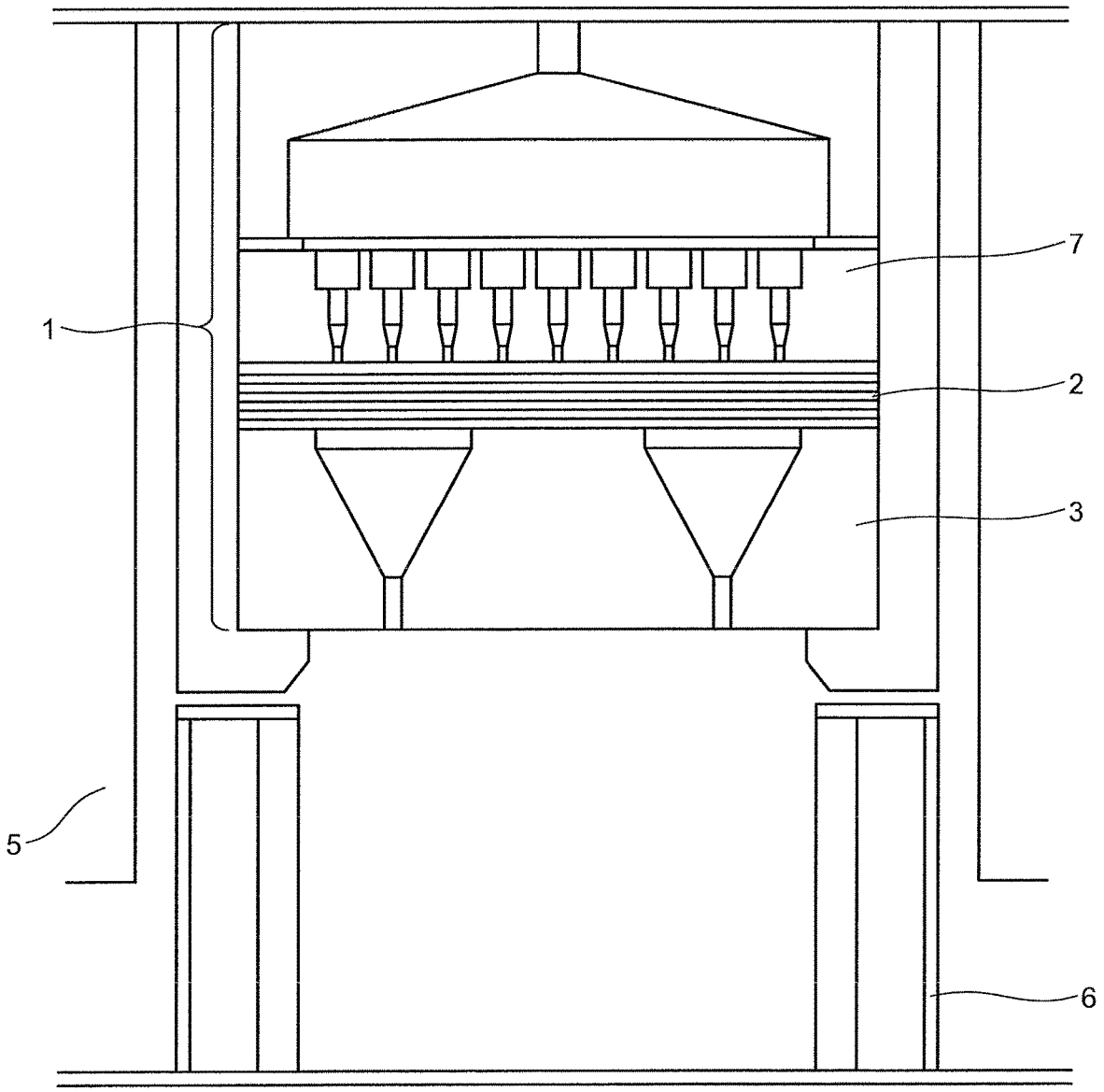
FIG. 3 is a schematic sectional view around the pack for spinning and a cooling device according an embodiment of to the present invention.
Figure 4:
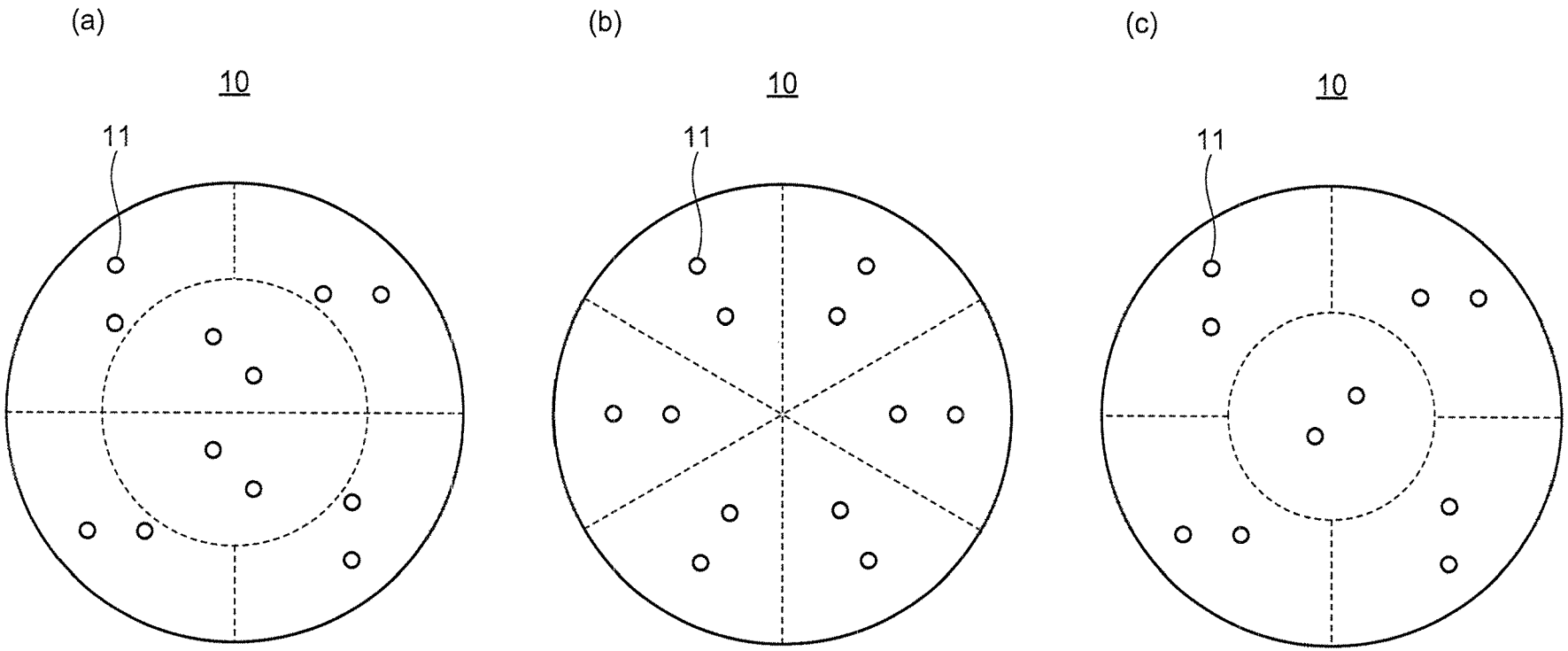
FIG. 4 is a view illustrating an example of virtual regions in the pack for spinning according an embodiment of to the present invention.

Hereinafter, the embodiments of the present invention will be described in detail with reference to the drawings. FIG. 1 is a schematic front sectional view schematically illustrating the pack for spinning according to an embodiment of the present invention. FIG. 2 is a schematic plan view schematically illustrating the configuration of a kneading part 2 placed in the pack for spinning 1 according to an embodiment of the present invention and FIG. 3 is a schematic sectional view around the pack for spinning and the cooling device according to an embodiment of the present invention. FIG. 4 is a view illustrating an example of the virtual regions in the pack for spinning according to an embodiment of the present invention. These views are conceptual views for accurately illustrating the gist of the present invention and the views are simplified.

Reference is made to FIG. 1 and FIG. 3. The pack for spinning 1 according to embodiments of the present invention is configured of a filter medium 8, a filter 9, a porous plate 7, a kneading part 2, and a spinneret 3 towards the downstream side in the polymer spinning path direction illustrated as the arrow X direction in FIG. 1. In a spinning device, the pack for spinning 1 is fixed in a heating box 5 and a cooling device 6 is disposed just below the spinneret 3. The polymer directed to the pack for spinning 1 passes through the filter medium 8 and the filter 9, passes through the porous plate 7 and the kneading part 2, and is spun from discharge holes 4 of the spinneret 3. Thereafter, the spun polymer is cooled by the air flow blown from the cooling device 6, applied with an oil agent, and thereafter wound up as a fiber. In FIG. 3, the cyclic cooling device 6 that blows airflow in a cyclic inward direction is employed. A cooling device 6 that blows airflow from one direction may be used. With regard to members provided in the upstream side of the pack for spinning 1, a flow path or the like used in the existing pack for spinning may be used. There is no need to prepare members specifically designed for the pack for spinning 1 according to embodiments of the present invention.

The kneading part 2 is configured of an introduction plate 10 and a plurality of kneading units 15 in order toward the downstream side in the polymer spinning path direction. Each of the kneading units 15 is configured of a supply plate 20 and a converging plate 30 in order toward the downstream side of the spinning path direction of the polymer.

Reference is made to FIG. 2. FIG. 2 is a schematic plan view schematically illustrating the introduction plate 10 configuring the kneading part 2 and the supply plate 20 and the converging plate 30 configuring one kneading unit 15. FIG. 2(*a*) is the introduction plate 10, FIG. 2(*b*) is the supply plate 20, and FIG. 2(*c*) is the converging plate 30. The kneading part 2 is divided into virtual regions R1 to R6 having an equal area on a face perpendicular to the polymer spinning path direction and separated in parallel with the polymer spinning path direction from the upstream side end to the downstream side end. In FIG. 2, borders of the virtual regions R1 to R6 are illustrated by broken lines. Each of the virtual regions R1 to R6 penetrates the kneading part 2 in the polymer spinning path direction and thus, as illustrated in FIGS. 2(*a*) to 2(*c*), the introduction plate 10, the supply plate 20 and the converging plate 30 are divided into the virtual regions R1 to R6 having the same size and arrangement.

In FIG. 2, each of the plates is divided into equally divided four virtual areas R1, R2, R4, and R5 in the outside and equally divided two virtual areas R3 and R6 in the inside. However, the division of the virtual region is not limited thereto. For example, the virtual region may be divided as illustrated in FIGS. 4(*b*) and 4(*c*).

As illustrated in FIG. 2(*a*), in the introduction plate 10, two first introduction holes 11 that penetrate the introduction plate 10 are formed in each of the virtual regions R1 to R6. In FIG. 2(*a*), an example in which the two first introduction holes 11 are formed in one virtual region is illustrated. The present invention is not limited thereto and a plurality of holes may be employed.

As illustrated in FIG. 2(*b*), in the supply plate 20, a plurality of supply grooves 21 that open on the upstream side surface in the polymer spinning path direction and communicate with different virtual regions are formed. Each of the supply grooves 21 is formed so that a first end 23 of the supply groove 21 is located just below one of the first introduction holes 11 formed in the introduction plate 10. In the supply plate 20 disposed downstream of the converging plate 30, the first end 23 is formed so as to be just below one of the second introduction holes 32 formed in the converging plate 30. In a second end 24 that is the other end of the supply groove 21, a supply hole 22 penetrating from the supply groove 21 to the surface on the downstream side in the polymer spinning path direction is formed.

As illustrated in FIG. 2(*c*), in the converging plate 30, a converging groove 31 that opens on the upstream side surface in the polymer spinning path direction is formed in each of the virtual regions R1 to R6. The converging groove 31 has a shape in which two grooves are converged. The converging groove 31 is formed so that each of the first ends 33 of the groove configuring the converging groove 31 is located just below one of the supply holes 22 formed in the supply plate 20. At the second end 34 that is the remaining end of the groove configuring the converging groove 31, second introduction holes 32 penetrating from the converging groove 31 to the downstream side surface in the polymer spinning path direction are formed. In FIG. 2(*c*), the converging groove 31 indicates a shape in which two grooves are converged. Any shapes may be used as long as a plurality of grooves are converged.

The supply plate 20 and the converging plate 30 forming the kneading unit 15 may be separated as illustrated in FIGS. 1 to 3 and the supply plate 20 and the converging plate 30 may also be an integrally formed body. Furthermore, as illustrated in FIGS. 1 to 3, the kneading part 2 may be configured of the introduction plate 10 and the kneading units 15 and the kneading units 15 may be an integrally formed body. The kneading part 2 may also be an integrally formed body made of the introduction plate 10 and the kneading units 15.

Here, the principle for uniforming the viscosity unevenness caused by the thermal history difference of the inner and outer layers of the pack for spinning 1, which is the important point of the present invention, will be described using FIG. 2. In the description, attention will be paid on the flow of the polymer introduced from the first introduction holes 11*a* of the virtual region R1 to describe the principle.

(1) The polymer flowed to the kneading part 2 is divided by the introduction plate 10 into the virtual regions R1 to R6. The polymer is led to a first introduction hole 11*a* disposed in one virtual region R1 in the virtual regions and thereafter flows into the supply plate 20.

(2) The polymer supplied from the first introduction hole 11*a* to the supply plate 20 flows through a supply groove 21*a* to a supply hole 22*a* formed in another virtual region R2 different from the virtual region R1 in which the first introduction hole 11*a* is formed so as to be indicated by the broken line arrow in FIG. 2(*b*) and flows to the converging plate 30.

(3) As illustrated in FIG. 2(*c*), the polymer supplied to the converging plate 30 flows from the first end 33 of a converging groove 31*a* to an intersection part of the grooves. This polymer is once converged to a polymer flowed from the other supply hole 22 and thereafter is distributed again to flow toward a second end 34. The distributed polymer flows from the second introduction holes 32*a* and 32*b* to the further downstream side.

(4) In the case where another kneading unit 15 made of the supply plate 20 and the converging plate 30 illustrated in FIG. 2(*b*) and FIG. 2(*c*) is further disposed on the downstream side of the kneading unit 15, the polymer flowing from the second introduction hole 32*a* in the converging plate 30 flows into the supply groove 21*b* in the supply plate 20 (refer to FIG. 2(*b*)), then flows into the supply hole 22*b* formed in the virtual region R5 different from the virtual region R2 in which the second introduction hole 32*a* is formed, and flows to the converging plate 30. The polymer supplied to the converging groove 31*b* flows from the first end 33 of the converging groove 31*b* to the intersection part of the grooves. This polymer is once converged to a polymer flowed from the other supply hole 22 and thereafter is distributed again to flow toward a second end 34. The distributed polymer flows from the second introduction holes 32*c* and 32*d* to the further downstream side.

(5) The polymer flowing from the second introduction hole 32 of the converging plate 30 configuring the most downstream kneading unit 15 flows to the spinneret 3 as it is and converges with the polymer flowing from the other second introduction holes 32.

As described above, the supply plate 20 and the converging plate 30 are assembled as the kneading unit 15 and the kneading units 15 are arranged in a stacked manner, whereby the second introduction hole 32 of the converging plate 30 and the supply groove 21 of the supply plate 20 are communicated with each other and thus the polymer is repeatedly distributed and converged.

In other words, on the downstream side of the introduction plate 10 in which the flow paths distributing the polymer to the virtual regions are formed, the kneading part 2 is configured by repeatedly stacking the kneading units 15 formed by the combination of the supply plate 20 allowing the polymer to flow to another virtual region and the converging plate 30 converging the polymer flowing from the virtual regions and thereafter distributing the converged polymer. By using such a configuration, when the polymer flowing into one virtual region located at the upper part of the kneading part 2 flows from a virtual region located at the lower part of the kneading part 2, the polymer is converged with a polymer supplied from another virtual area and the converged polymer is distributed. In other words, kneading is carried out. This allows the difference in the thermal history to be gradually reduced by converging the polymers having different thermal history in the inner layer part and the outer layer part and flowing from the virtual regions in the converging groove 31 and thereafter distributing the converged polymer when the polymer passes through the kneading part 2.

The kneading part 2 has the following configuration in order to obtain a more suitable kneading effect when the supply plate 20 and the converging plate 30 are stacked to repeat kneading. First, attention is paid on the supply grooves 21 (hereinafter, referred to as the supply grooves 21' for descriptive purpose) communicating on the upstream side in the polymer spinning path direction and the supply grooves 21 (hereinafter, referred to as the supply grooves 21" for descriptive purpose) communicating in the downstream side in the polymer spinning path direction though an arbitrary converging groove 31 (hereinafter, referred to as the converging groove 31' for descriptive purpose) in the converging plate 30. The individual first ends 23 of the supply grooves 21' communicating on the upstream side are disposed in a virtual region different from the virtual region where the converging groove 31' is disposed. The individual second ends 24 of the supply grooves 21" communicating on the downstream side are also disposed in a virtual region different from the virtual region where the converging groove 31' is disposed. It is important that the virtual region where the second end 24 of at least one supply groove 21" on the downstream side is disposed is different from any virtual regions where the second end 24 of each of the supply grooves 21' on the upstream side is disposed. In order to form such configuration, the polymer flowing from the first end 23 of each of the supply grooves 21' on the upstream side and converged at the converging groove 31' though the supply grooves 21' is distributed again at the converging groove 31'. At least a part of the distributed polymer flows from the second end 24 disposed in the virtual region different from the virtual region into which the polymer originally flows through the supply grooves 21". The same configuration is also applied to any of the supply grooves 21 communicating with the upstream side and the downstream side in the polymer spinning path direction through the converging groove 31.

With such a configuration of the kneading part 2, the kneading is carried out in a manner that at least a part of the polymer does not reciprocate between specific virtual regions but surely flows to another virtual region and is converged and distributed each time. Therefore, a collective product of the polymer flowing from all of the virtual regions that are virtually divided is formed by repeating the kneading and thus a high kneading effect can be obtained. The polymer that is merely converged and distributed has a low kneading effect. In the case where all of the virtual regions where the first ends 23 of the supply grooves 21 on the upstream side are disposed and the virtual regions where the second ends 24 of the supply grooves 21 on the downstream side are disposed communicating through the converging groove 31 are the same, only the flow paths where the polymer is merely reciprocated are substantially formed and the polymer having a low degree of kneading is only returned to the same position. Therefore, the sufficient kneading effect may fail to be obtained by repeating this operation.

Figure 5:
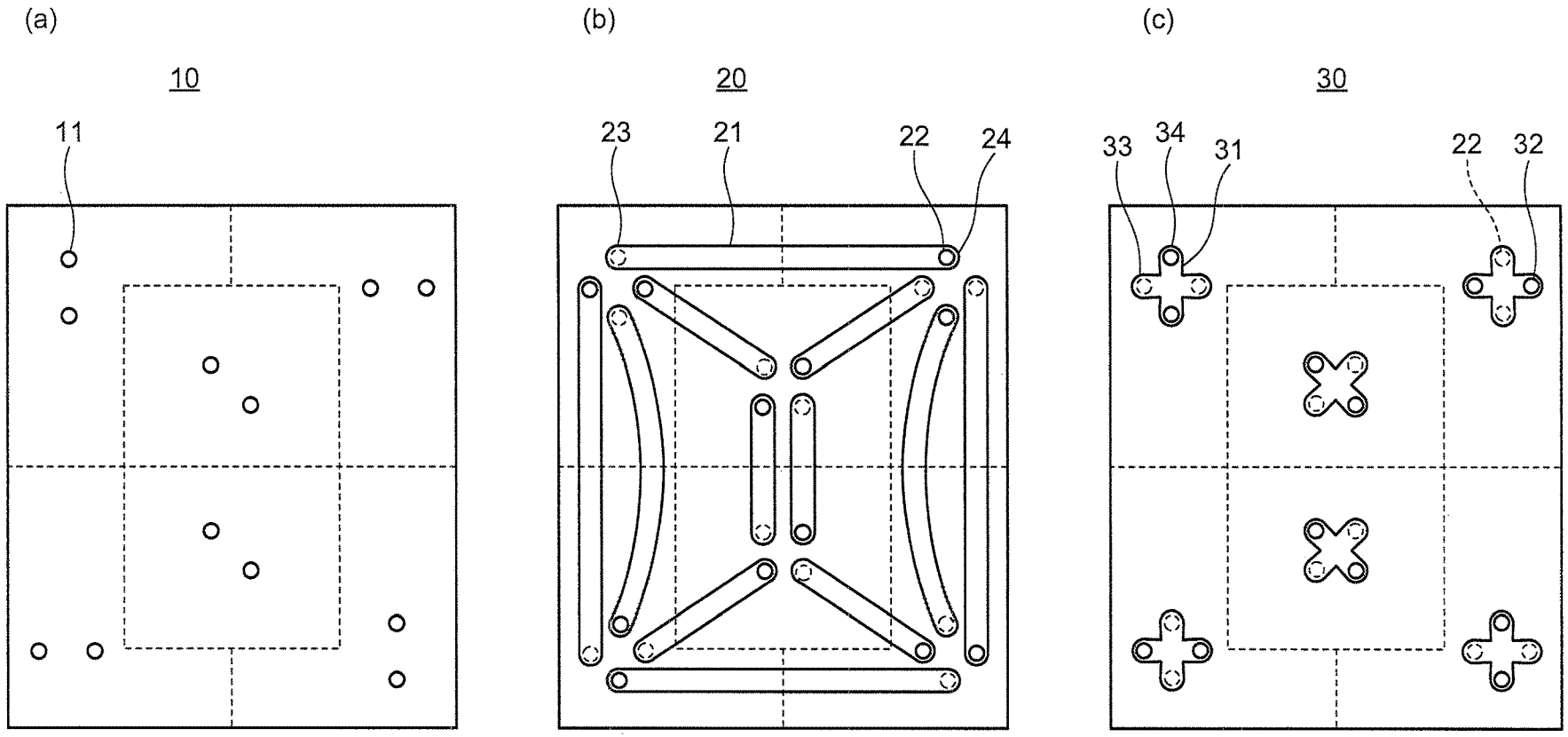
FIG. 5 is a schematic plan view of each of (a) the introduction plate, (b) the supply plate, and (c) the converging plate in a rectangular pack for spinning according to an embodiment of the present invention.

The polymer flow described above can be formed regardless of the shape of the pack for spinning. Therefore, similar kneading effect can be obtained by not only the circular pack for spinning 1 as illustrated in FIG. 2 but also the rectangular pack for spinning as illustrated in FIG. 5. FIG. 5 is a schematic plan view of each of (a) the introduction plate, (b) the supply plate, and (c) the converging plate in a rectangular pack for spinning according to an embodiment of the present invention.

Figure 6:
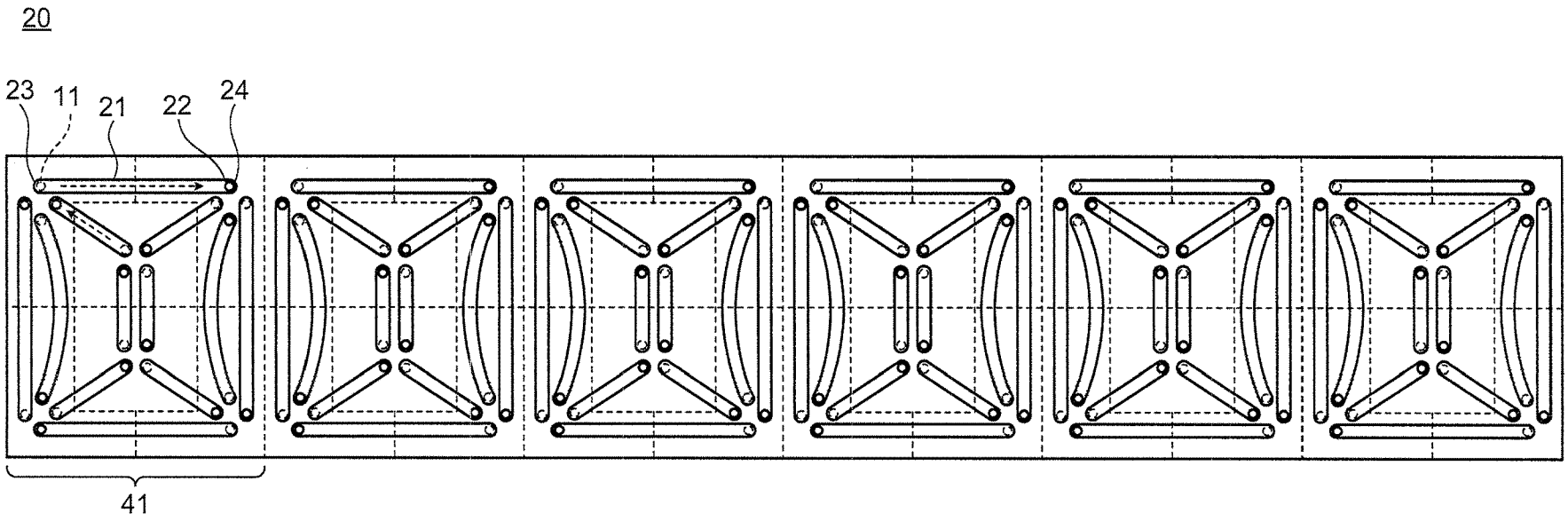
FIG. 6 is a schematic plan view of the supply plate in a long pack for spinning according to an embodiment of the present invention.

In particular, in a long pack for spinning, collecting the polymer from all virtual regions may be difficult to carry out because the travel distance of the polymer is long. In such a case, the polymer is not collected from all of the virtual regions but kneaded in a plurality of collective bodies 41 of each of the virtual regions by forming the collective bodies 41 of the specific virtual regions as illustrated in FIG. 6, whereby a high kneading effect is obtained in the collective bodies 41 of each of the virtual regions. Finally, filaments having no physical property difference and uniform quality can be obtained. FIG. 6 is a schematic plan view of the supply plate in the long pack for spinning according to an embodiment of the present invention. In the long pack for spinning according to embodiments of the present invention, the collective bodies 41 of the specific virtual regions may have a low kneading effect if the collective bodies 41 are excessively long in the long side direction, and thus the area of the collective bodies 41 of the virtual regions is preferably determined to be an area of 20% or smaller of the whole regions. The collective bodies 41 of the virtual regions are preferably formed so that the aspect ratio, which is a ratio of the lengths of the long side direction and the short side direction of the collective bodies 41 of the virtual regions, is preferably 3 or lower.

Applying the pack for spinning 1 according to embodiments of the present invention allows a uniform polymer having no viscosity unevenness to be discharged. Applying the pack for spinning 1 according to embodiments of the present invention also allows filaments having uniform quality and less physical unevenness to be obtained. Converging and distribution of the polymer are carried out more than once. This allows even a polymer having high viscosity in a laminar state to be surely kneaded.

In the pack for spinning 1, when the polymer flow through another virtual region by the supply groove 21, the virtual region where the first end 23 is disposed and the virtual region where the second end 24 is disposed in the supply groove 21 are preferably adjacent to each other. Such a configuration causes the length of the polymer flow path in the direction perpendicular to the polymer spinning path direction to be short. Therefore, the uniform quality filaments having less thermal history difference received in the kneading part 2 and less physical property unevenness can be obtained. At the same time, residential time becomes shorter. Therefore, thermal deterioration is reduced and the excellent fiber processability can be obtained.

In the pack for spinning 1, the number of D of the first introduction holes 11 and second introduction holes 32 each are formed in each virtual region. When the number of divisions of the virtual regions is determined to be R, the number of the kneading units 15 is determined to be n, and the numbers of the first introduction holes 11 and the second introduction holes 32 are determined to be D, the degree of kneading M defined by the following formula is preferably 0.6 or higher. The pack for spinning having a degree of kneading M of 0.6 or higher allows a higher kneading effect to be obtained.

$$M=(1-1/D^n)\times(1-1/R)$$

In order to obtain the same kneading effect in all the divided virtual regions, the flow paths having equal flow path pressure loss are preferably formed so that each of the flow rate of the polymer passing through the first introduction holes 11, the second introduction holes 32, and the supply holes 22 are equal.

As a method for producing the kneading part 2 used for the pack for spinning 1 according to embodiments of the present invention, the kneading part 2 can be formed by dividing each flow path in the transverse sectional direction of the kneading part 2, individually producing the introduction plate 10, the supply plate 20, and the converging plate 30 that are plates in which each divided flow path is processed, and stacking these plates.

The thickness of the kneading part 2 is preferably formed as thin as possible from 2 mm to 60 mm within the range that can satisfy the required number of times of kneading. Such a configuration allows the length of the polymer flow path to be short. Therefore, the residential time becomes shorter, thermal deterioration is reduced, and the excellent fiber processability can be obtained by converging the polymer in a slight space. The kneading part 2 is thin and the space required for installation is small. Therefore, even when the kneading part 2 is additionally incorporated into an existing pack, the kneading part 2 also has advantages that change in other members is small and the incorporation is easy.

Use of the pack for spinning 1 according to embodiments of the present invention allows more remarkable effects to be obtained for fine fineness varieties having a single yarn fineness of 6 dtex to 30 dtex and varieties having the small number of filaments. This is because the fine fineness varieties and the varieties having the small number of filaments require small discharge amounts of the polymer, and thus the amount of heat brought by the polymer in the pack for spinning 1 is small and the temperature unevenness of the polymers having different thermal history in the inner layer part and the outer layer part in the pack tends to be large, and consequently the viscosity unevenness is easily affected.

Examples of the polymer used in embodiments of the present invention include polyesters represented by, for example, polyethylene terephthalate, polytrimethylene terephthalate, polybutylene terephthalate, polylactic acid, and polyethylene naphthalate and polyamides represented by, for example, nylon 6 and nylon 66. However, the polymer is not particularly limited thereto.

The pack for spinning 1 according to the present invention is not limited to uniforming single component polymers. For example, in the case where the present invention is applied to a composite polymer using two or more kinds of polymers, the polymers can be kneaded with each other by repeating converging and distribution. The number of times of kneading can be changed by changing the number of layers in the kneading unit and thus the degree of kneading of the polymer can be easily controlled.

As described above, the pack for spinning according to the present invention can be applied not only to the circular pack for spinning and the rectangular pack for spinning but also to the long pack for spinning. The number of virtual regions, the number of distributed polymers, the numbers of the first introduction holes, the second introduction holes, supply grooves, and converging grooves and the size ratio thereof can be appropriately changed depending on the embodiment.

The present invention can be applied not only to the pack for spinning used in a general melt spinning method, but also to a pack for spinning used in a solution spinning method. However, the scope of application is not limited thereto.

EXAMPLE

Hereinafter, the present invention will be further specifically described with reference to Examples. The methods for measuring characteristic values and the like in Examples are as follows.

(1) Fineness

A fiber sample was set on a counter reel having a size of 1.125 m/turn and the counter reel was rotated 400 times to prepare a loop-like skein. The skein was dried with a hot air drier (105±2° C.×60 minutes) and, after drying, the skein weight was measured by a balance scale. The fineness was calculated from a value obtained by multiplying the obtained skein weight by the official moisture content. The official moisture content was determined to be 4.5%.

(2) Fineness Difference

Each fineness of yarns obtained from one spinneret was measured according to (1) and the difference between the maximum fineness value and the minimum fineness value was determined to be the fineness difference. The fineness difference was evaluated in a manner that when the fineness difference relative to the standard fineness was 2% or smaller, the fineness difference was determined to be ○, whereas when the fineness difference relative to the standard fineness was larger than 2%, the fineness difference was determined to be X.

Example 1

Nylon 6 chips having a relative viscosity in sulfuric acid of 2.73 were melted at 285° C. and the melted nylon 6 was spun from the discharge holes 4 of the spinneret 3 through the filter medium 8, the filter 9, the porous plate 7, and the kneading part 2 described blow in a discharge rate of 22.5 g/minute. Thereafter, the spun nylon 6 was cooled with air flow blown from the cooling device 6 and an oil agent was applied. Thereafter, the nylon 6 was wound as a fiber to give six yarns of nylon 6 multifilament having a standard fineness of 11 dtex.

Figure 7:
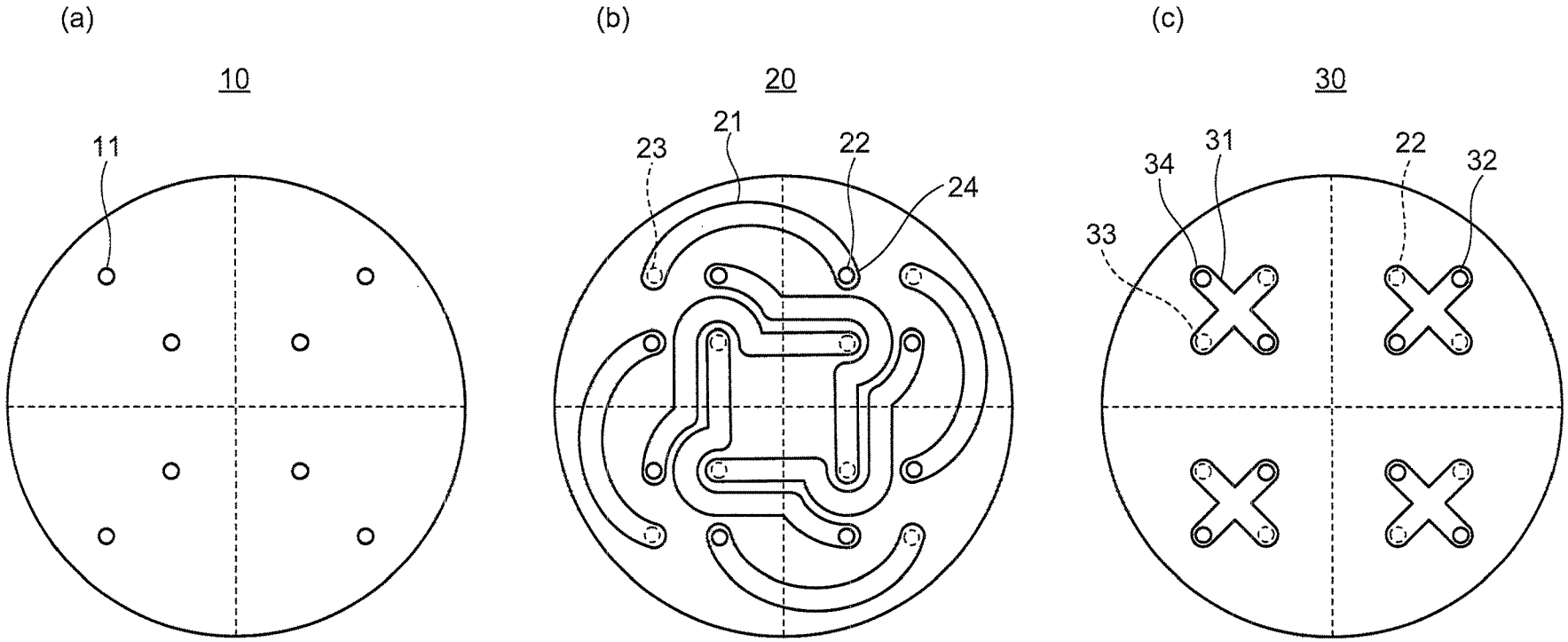
FIG. 7 is a schematic plan view of each of (a) the introduction plate, (b) the supply plate, and (c) the converging plate in another embodiment of the circular pack for spinning according to the present invention.

The used kneading part 2 is configured of the kneading units 15 made of the introduction plate 10, the supply plate 20, and the converging plate 30 illustrated in FIG. 7. The polymer is kneaded by distribution and converging in one kneading unit 15. The number of components of the kneading units 15 is defined as "the number of times of kneading". The number of times of kneading in Example 1 is three. In the flow paths configuring the kneading unit 15, a ratio of the flow paths in which the virtual region where the second end 24 of the supply groove 21 communicating on the downstream side in the polymer spinning path direction through the converging groove 31 of the converging plate 30 is disposed and at least one of the virtual regions where the first ends 23 of the supply grooves 21 communicating on the upstream side in the polymer spinning path direction are disposed are the same is defined as a "reciprocating flow path ratio". The reciprocating flow path ratio in Example 1 is 0.5. When the polymer flows from the first end 23 to the second end 24 through the supply groove 21 of the supply plate 20, a ratio in which the virtual region where the first end 23 is disposed and the virtual region where the second end 24 is disposed are adjacent is defined as an "adjacency ratio". The adjacency ratio of Example 1 is 0.5. The number of introduction holes D is 2 and the number of divisions of the virtual regions R is 4. The degree of kneading M of Example 1 is 0.66.

As a result of measuring the fineness of the six yarns of the nylon 6 multifilament as listed in Table 1, the fineness difference was 1.9%. In other words, the nylon 6 polymer is repeatedly distributed and converged three times in the kneading part and is directly distributed to the discharge holes in a uniformed state. Therefore, it is found that the single yarns spun from each of the spinneret discharge holes have no quality difference between the single yarns.

Example 2

The same kneading part 2 as the kneading part in Example 1 except that the supply grooves 21 of the supply plate 20 was changed so that the reciprocating flow path ratio was 0.75 and the adjacency ratio was 1 was used. Spinning was carried out using the same polymer and the same fineness and spinning conditions in Example 1 to collect multifilament.

As a result of measuring the fineness of the six yarns of the nylon 6 multifilament as listed in Table 1, the fineness difference was 1.7%. The flow path length of the polymer passing through the kneading part 2 was shorter and the thermal history difference in the kneading part 2 was smaller, and thus the fineness difference was smaller than the fineness difference in Example 1.

Example 3

Using the kneading units 15 made of the introduction plate 10, the supply plate 20, and the converging plate 30 illustrated in FIG. 2 and determining the number of times of kneading to be 6, the number of introduction holes D to be 2, and the number of divisions of the virtual regions R to be 6 allowed the kneading part 2 to be configured so that the degree of kneading M was 0.82. The reciprocating flow path ratio was 0.5 and the adjacency ratio was 1. Spinning was carried out using the same polymer and the same fineness and spinning conditions in Example 1 to collect multifilament.

As a result of measuring the fineness of the six yarns of the nylon 6 multifilament as listed in Table 1, the fineness difference was 1.3%. The polymer was more kneaded by increasing the number of times of kneading and the degree of kneading M and thus the fineness difference was smaller than the fineness difference of Example 2.

Comparative Example 1

Spinning was carried out by the same method in the method in Example 1 except that a pack for spinning in which a filter medium, a filter, a porous plate, a one-hole kneading part (the number of times of kneading was 1), and a spinneret were disposed in this order having a configuration according to Patent Literature 1 was used to give six yarns of nylon 6 multifilament having a standard fineness of 11 dtex.

The one-hole kneading part is configured of converging flow paths in which the polymer passing through the filter medium is converged at one position while contracting the polymer flow at the center part of the pack for spinning and a plurality of circular tube flow paths circumferentially arranged at an equal interval extending from an outlet part at the end of the converge part in the downstream direction. When the one-hole kneading part is regarded as the kneading unit according to embodiments of of the present invention, the number of components is one and thus the number of times of kneading was determined to be one.

As a result of measuring the fineness of the six yarns of the nylon 6 multifilament as listed in Table 1, the fineness difference was higher than 3%. Namely, it is considered that the nylon 6 polymer is converged one time in the kneading part and thereafter distributed to each discharge hole and thus the viscosity unevenness caused by the thermal history difference of the polymer is generated, resulting in occurrence of quality difference among the single yarns spun from each spinneret hole.

Comparative Example 2

Spinning was carried out by the same method in the method in Example 3 except that a pack for spinning in which a filter medium, a filter, a porous plate, a static kneading element (the number of times of kneading was 6, the reciprocating flow path ratio was 1, and the adjacency ratio was 1) and a spinneret were disposed in this order having a configuration according to Patent Literature 2 was used to give six yarns of nylon 6 multifilament having a standard fineness of 11 dtex.

The static kneading element is configured by stacking mixing plates and these mixing plates are regarded as the kneading units according to embodiments of the present invention. In order to compare with Example 3, the number of components of the mixing plates was determined to be six and the number of times of kneading was determined to be six. The channels were formed in a grid shape in each of the mixing plates. The number of virtual regions was six when each region divided so as to include one grid point was regarded as the virtual region according to embodiments of the present invention. When the channels were regarded as the supply grooves according to embodiments of the present invention and the outlet holes were regarded as the converging grooves according to embodiments of the present invention, the reciprocating flow path ratio was 1 and the adjacency ratio was 1.

As a result of measuring the fineness of the six yarns of the nylon 6 multifilament as listed in Table 1, the fineness difference was higher than 2%. In other words, although the nylon 6 polymer is kneaded by the static kneading element, all the flow paths in the static kneading element are a reciprocating flow paths. Consequently, the kneading effect is small compared with Example 3 having the same number of times of kneading. Therefore, it is considered that the viscosity unevenness caused by the thermal history difference before passing through the static kneading element is not improved even after passing through the static kneading element and a quality difference among single yarns spun from each of the spinneret holes is generated.

TABLE 1

| | | Example 1 | Example 2 | Example 3 | Comparative Example 1 | Comparative Example 2 |
|---|---|---|---|---|---|---|
| Number of times of kneading | [—] | 3 | 3 | 6 | 1 | 6 |
| Reciprocating flow path ratio | [—] | 0.5 | 0.75 | 0.5 | — | 1 |
| Adjacency ratio | [—] | 0.5 | 1 | 1 | — | 1 |
| Degree of kneading M | [—] | 0.66 | 0.66 | 0.82 | — | — |
| Fineness difference | [%] | 1.9 | 1.7 | 1.3 | 3.5 | 2.7 |
| | Determination | ○ | ○ | ○ | X | X |

REFERENCE SIGNS LIST

1 Pack for spinning
2 Kneading part
3 Spinneret
4 Discharge hole
5 Heating box
6 Cooling device
7 Porous plate
8 Filter medium
9 Filter
10 Introduction plate
11 First introduction hole
15 Kneading unit
20 Supply plate
21, 21', 21" Supply groove
22 Supply hole
23 First end
24 Second end
30 Converging plate
31, 31' Converging groove
32 Second introduction hole
33 First end
34 Second end
41 Collective body of virtual regions

The invention claimed is:

1. A pack for spinning being a pack that is used for a production process of a fiber and that is provided with a kneading part disposed on a spinneret, the kneading part comprising:

an introduction plate including a plurality of first introduction holes for introducing a melted polymer; and a plurality of stacked kneading units, each kneading unit including:

a supply plate including a plurality of independent supply grooves into which the polymer introduced from the introduction holes flows and one or more supply holes disposed in each of the supply grooves, and a converging plate including a plurality of converging grooves in which a plurality of grooves into which the polymer supplied from the supply holes flows are intersected and a plurality of second introduction holes disposed in each of the converging grooves, wherein when the kneading part is divided into virtual regions including an equal area on a face perpendicular to a polymer spinning path direction and separated in parallel with the polymer spinning path direction from an upstream side end to a downstream side end, the first introduction holes penetrating the introduction plate are formed in each of the divided virtual regions;

each first end of the supply grooves is disposed just below the corresponding first introduction hole or the corresponding second introduction hole, each second end of the supply grooves is disposed in a virtual region different from a virtual region where the first end is disposed, and each of the supply holes is formed in each second end of the supply grooves;

the converging grooves are disposed in the respective divided virtual regions, each first end of the grooves configuring the converging grooves is disposed just below the corresponding supply hole, and each of the second introduction hole is formed in each second end of the grooves configuring the converging grooves; and when the supply grooves on an upstream side and the supply grooves on a downstream side communicate with each other through the converging grooves, a second end of at least one supply groove on the downstream side is disposed in a virtual region different from any virtual regions where the first ends of the supply grooves on the upstream side are disposed.

2. The pack for spinning according to claim 1, wherein the virtual region where the first end of the supply groove is disposed is adjacent to the virtual region where the second end of the supply groove is disposed.

3. The pack for spinning according to claim 1, wherein a degree of kneading M defined by the following formula:

$$M=(1-1/D^n)\times(1-1/R)$$

is 0.6 or higher where number of divisions of the virtual regions is R, number of the first introduction holes and the second introduction holes formed in one of the virtual regions is D, and number of the kneading units is n.

4. A method for producing a fiber, the method comprising producing a fiber using the pack for spinning according to claim 1.

* * * * *